United States Patent [19]

Dooley

[11] Patent Number: 4,765,698

[45] Date of Patent: Aug. 23, 1988

[54] WASHER BACKSPLASH ASSEMBLY

[75] Inventor: Eddie W. Dooley, Jeffersonville, Ind.

[73] Assignee: General Electric Company, Louisville, Ky.

[21] Appl. No.: 920,750

[22] Filed: Oct. 20, 1986

[51] Int. Cl.[4] ..... D06F 1/02

[52] U.S. Cl. ..... 312/248; 312/257 SM

[58] Field of Search ..... 312/228, 257 R, 257 SK, 312/257 SM, 108; 220/337

[56] References Cited

U.S. PATENT DOCUMENTS

| | | | |
|---|---|---|---|
| 1,705,156 | 3/1929 | Larson | 312/257 R |
| 2,483,606 | 10/1949 | Albach et al. | 312/257 R |
| 2,899,253 | 8/1959 | Jacobs | 312/257 |
| 3,101,226 | 8/1963 | Cochran | 312/257 R |
| 3,378,320 | 4/1968 | Morgan et al. | 312/257 R |
| 4,003,613 | 1/1977 | Oakley | 312/293 |
| 4,268,098 | 5/1981 | Kretchman et al. | 312/210 |
| 4,482,074 | 11/1984 | Lalley | 312/257 SM |
| 4,531,387 | 7/1985 | Cotton et al. | 68/3 R |

*Primary Examiner*—Joseph Falk

*Attorney, Agent, or Firm*—Radford M. Reams; Frederick P. Weidner

[57] ABSTRACT

A front serviceable appliance includes an outer removable cabinet having side walls, a front wall and an upper wall on which is mounted a control console. The cabinet is mounted on a support structure on which are mounted the internal components of the appliance. The support structure includes a base frame and a rear panel which supports components of the appliance. The rear panel is attached at its lower end to the base frame with its upper end extending upwardly beyond the upper wall of the cabinet. The cabinet is held in position relative to the rear panel and the base frame by the control console interacting with the upper end of the rear panel and the upper wall of the cabinet. The control console includes end walls which are secured to the upper wall of the cabinet. A pair of locking members arranged on the upper end of the rear panel adjacent each end wall are secured to the end walls to thereby removably retain the cabinet relative to the rear panel and base frame.

11 Claims, 4 Drawing Sheets

FIG. 6
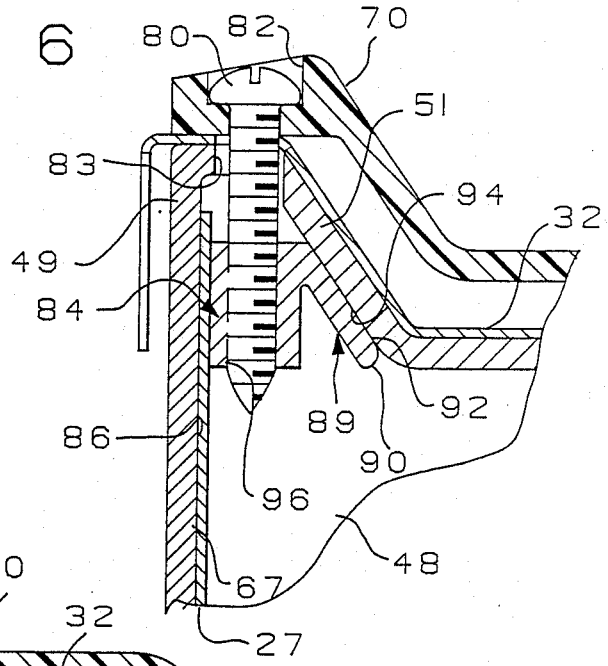
FIG. 4
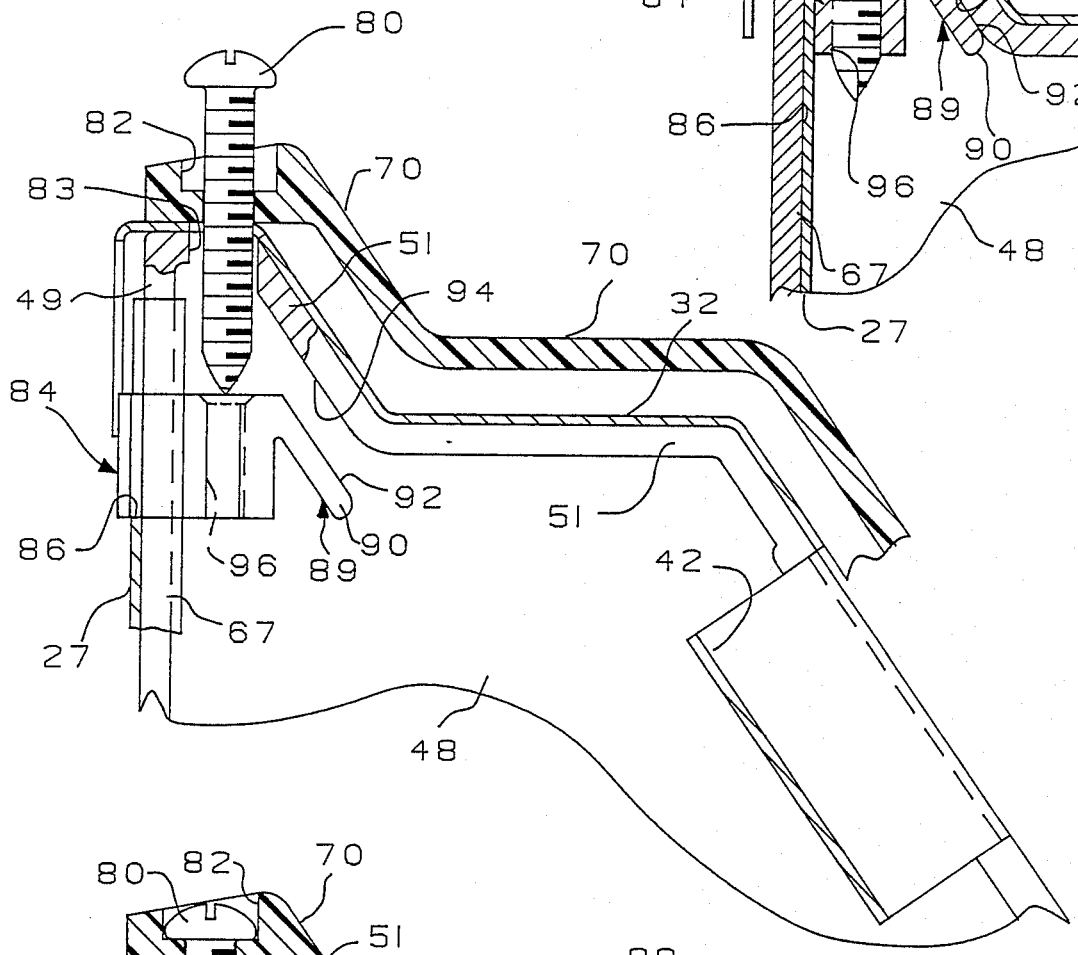
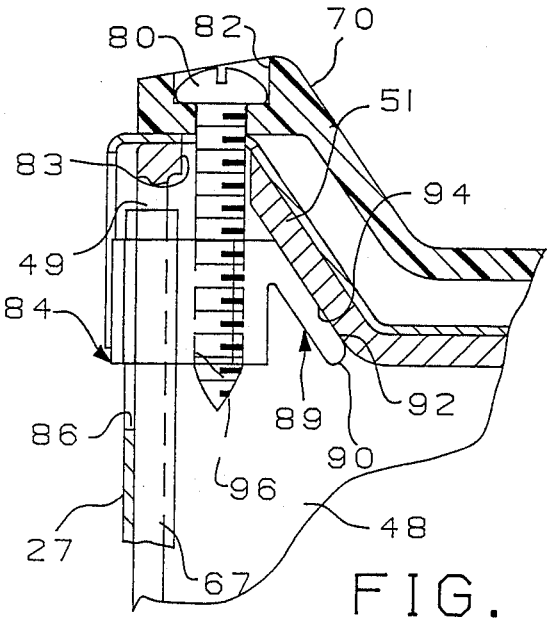
FIG. 5
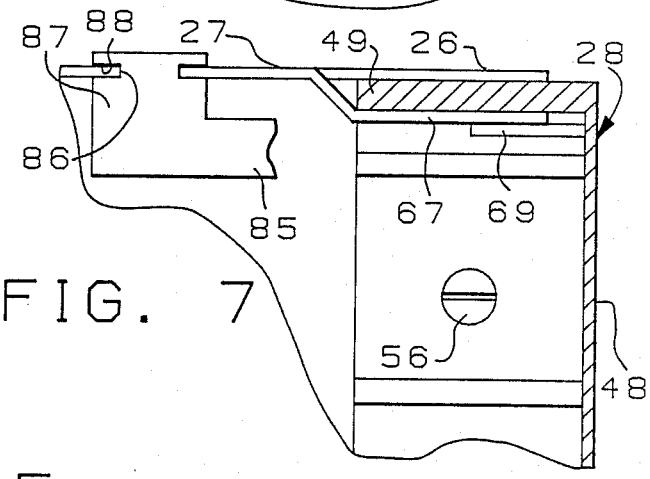
FIG. 7

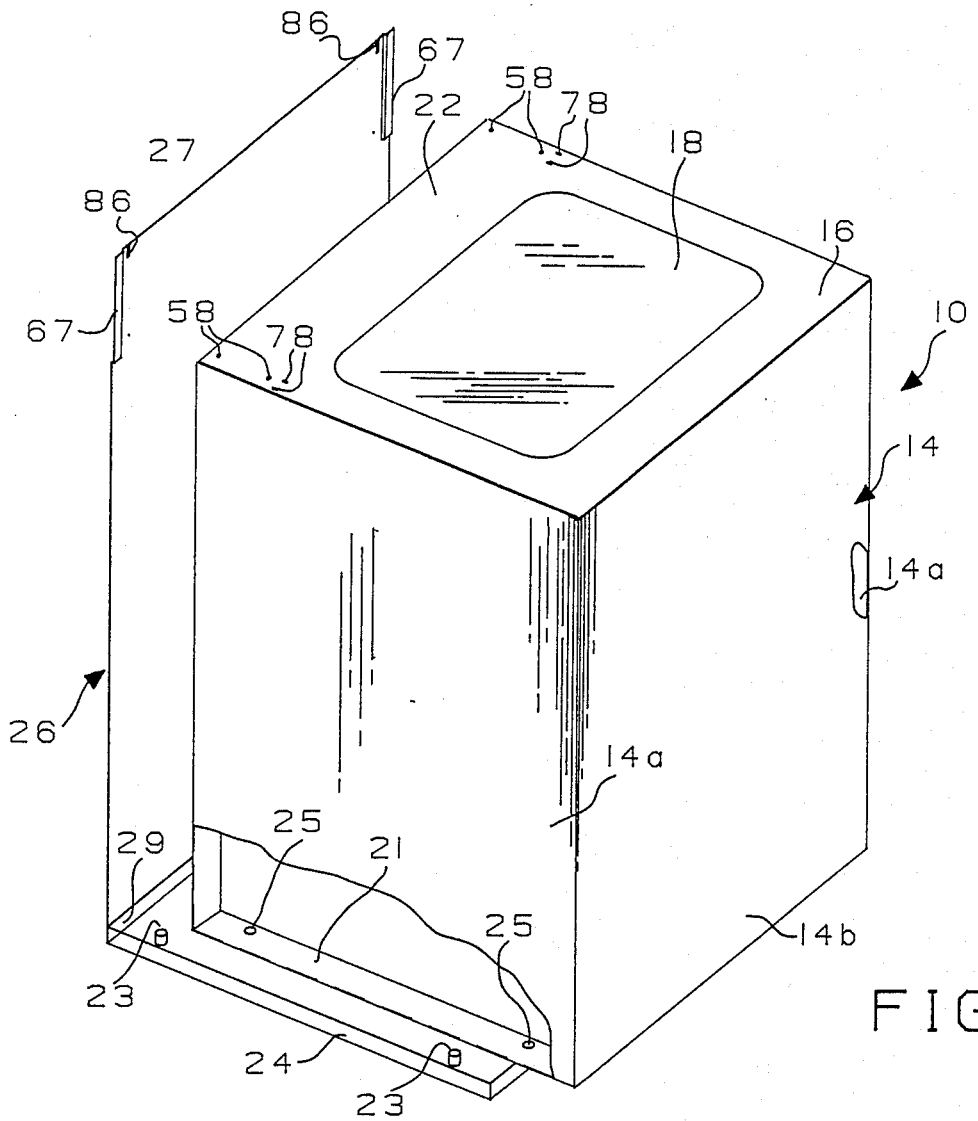
FIG. 8
FIG. 9
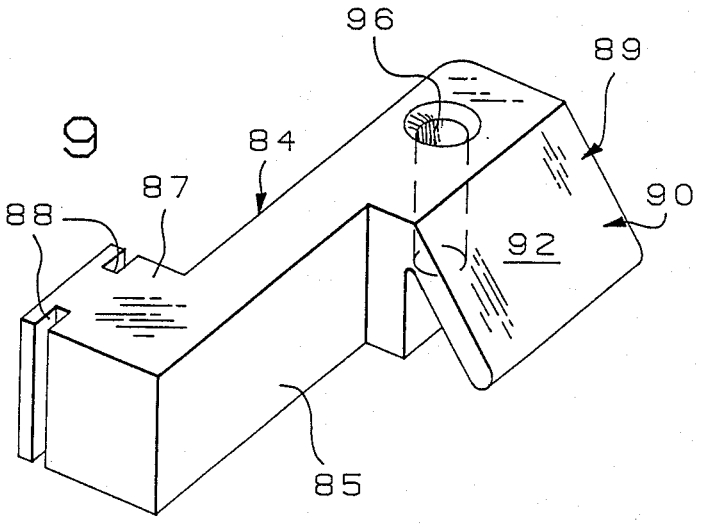

WASHER BACKSPLASH ASSEMBLY

BACKGROUND OF THE INVENTION

The present invention relates to cabinets for appliances, and particularly to removable cabinets for front serviceable appliances and the method of attaching such cabinets. The appliance includes a base frame which supports the internal components and an outer cabinet mounted on the base frame. A rear panel forming the rear closure of the cabinet is secured to the base frame. An appliance control console structure including spaced end walls is secured to a mounting portion of the appliance cabinet adjacent the rear panel. A pair of locking members arranged on the rear panel adjacent each end wall is engaged by a fastener on the console to thereby removably retain the cabinet relative to the rear panel and base frame.

Most domestic appliances, such as automatic washers, have internal operative components covered by a cabinet which is attached to a frame supporting the internal components. Servicing of the appliance is hampered because the internal components are inaccessible unless the cabinet is removed. Such cabinets are held in place by screws, bolts, or other attachment means which must be manually disengaged before the cabinet can be removed. An additional problem is that frequently some internal components are attached in some way to the cabinet so that once the cabinet is removed those parts become nonfunctional and must be rigged for operation without the cabinet in order to service the appliance.

SUMMARY OF THE INVENTION

An object of the present invention is to provide in a domestic appliance a control console which may be employed to removably secure the cabinet of the appliance relative to the support structure.

In accordance with the present invention there is provided a control console assembly in combination with a clothes washer having a removable cabinet for a front serviceable laundry appliance. The cabinet includes a wrapper having a front and two sides joined to a top. The cabinet wrapper is mounted on a support structure which includes a base frame on which are mounted the internal components of the clothes washer and a rear panel attached to the base. The control console structure housing the appliance control components includes means for removably maintaining the cabinet wrapper relative to the rear panel and base frame of the support structure. The console includes a pair of end walls secured to the top of the wrapper in spaced relationship to each other. A cover portion mounted to the end walls encloses the appliance control components. An arrangement for securing the end walls of the control console to the rear panel includes locking means mounted on the rear panel engageable by securing means on the end walls for maintaining the locking means and rear panel in engagement with the end walls of the console to thereby removably secure the cabinet relative to the rear panel and base frame of the support structure.

BRIEF DESCRIPTION OF THE DRAWINGS

FIG. 4 is an enlarged partial vertical sectional view showing the locking portions of the console and machine aligned prior to final assembly;

FIG. 5 is a view similar to FIG. 4 showing the locking portions in their secured positions;

FIG. 6 is a view similar to FIG. 5 showing the relationship of certain parts of the locking portions;

FIG. 7 is a sectional plan view taken along line 7—7 of FIG. 3;

FIG. 8 is a schematic perspective showing the cabinet relative to the support structure of the laundry machine; and FIG. 9 is a perspective view of the locking member employed for securing the console relative to the support structure of the laundry machine.

DESCRIPTION OF THE PREFERRED EMBODIMENT

Figure 1:
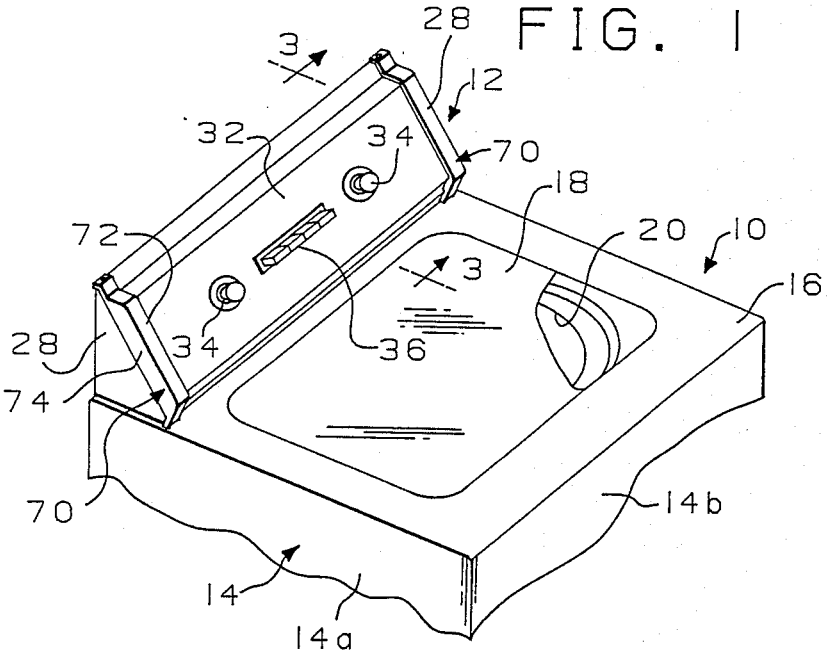
FIG. 1 is a partial perspective view of a laundry machine illustrating a control console and cabinet structure embodying the present invention.
Figure 2:
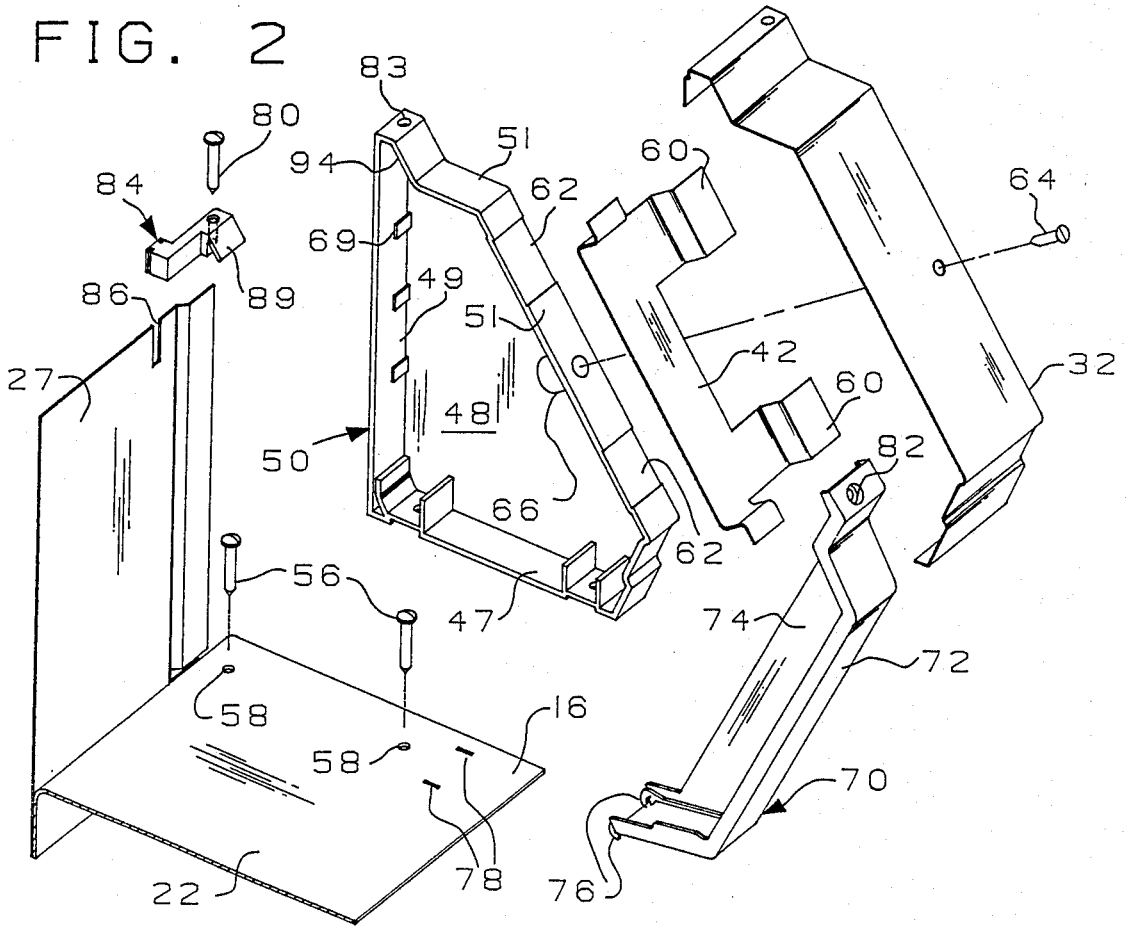
FIG. 2 is an exploded partial view of one end of the control console.

Referring to the drawings, and more particularly FIG. 1, the present invention is illustrated in connection with a laundry appliance 10 of the vertical axis type including a combined control console and backsplash 12 for a clothes washing machine. It should be noted however that the present control console can be applied to any cabinet structure in which a control console is required. The appliance 10 illustrated comprises a top-loading washing machine of the front-serviceable type having an outer cabinet 14 provided with a top wall 16 having a selectively manipulatable closure 18 closing a top opening 20 in the wall 16. The top wall 16 defines a rear or mounting portion 22 (FIGS. 2 & 8) on which is mounted the control console generally designated 12. The outer cabinet 14 includes a cabinet wrapper consisting of two side panels **14*a* and an integral front panel 14*b*. The cabinet 14 houses the customary components (not shown) of a vertical axis machine which are mounted on a support structure including a base 24 and a rear panel 26 (FIG. 8). The rear panel 26 is attached by suitable means such as screws 29 to the rear portion of the base 24, and extends upwardly therefrom. The upper end 27 of rear panel 26 extends upwardly beyond the top wall 16 of the cabinet 14, as shown in FIGS. 2 and 3, a distance equal substantially to the height of the console 12**.

The base 24 as stated above supports the major portions of the clothes washing machine components such as the clothes basket/tub, transmission, and drive motor (not shown). It should be noted that the rear panel 26 which is secured to the base may also serve to support other machine components such as water valves and selected electrical components (not shown). Accordingly the base 24 and panel 26 form the support structure for the internal components of the appliance. The cabinet 14 is positioned on the base 24 and restricted against horizontal movement relative to the base through the use of any suitable means. For example a plurality of pins 23 extending upwardly from the base 24 are dimensioned to be received in openings 25 arranged on a flange 21 formed along the side walls **14*a* of the cabinet 14**.

As shown in FIG. 1 the console 12 includes a pair of end walls generally designated 28, and a cover member 32. While the right hand end wall 28 is shown in detail in FIGS. 2–5 it should be noted that the left hand end wall 28 is generally a mirror image with each wall facing inwardly. Control knobs 34, and buttons 38 may be mounted to be disposed forwardly of the cover 32 for suitable manipulation by the user of the appliance.

Figure 3:
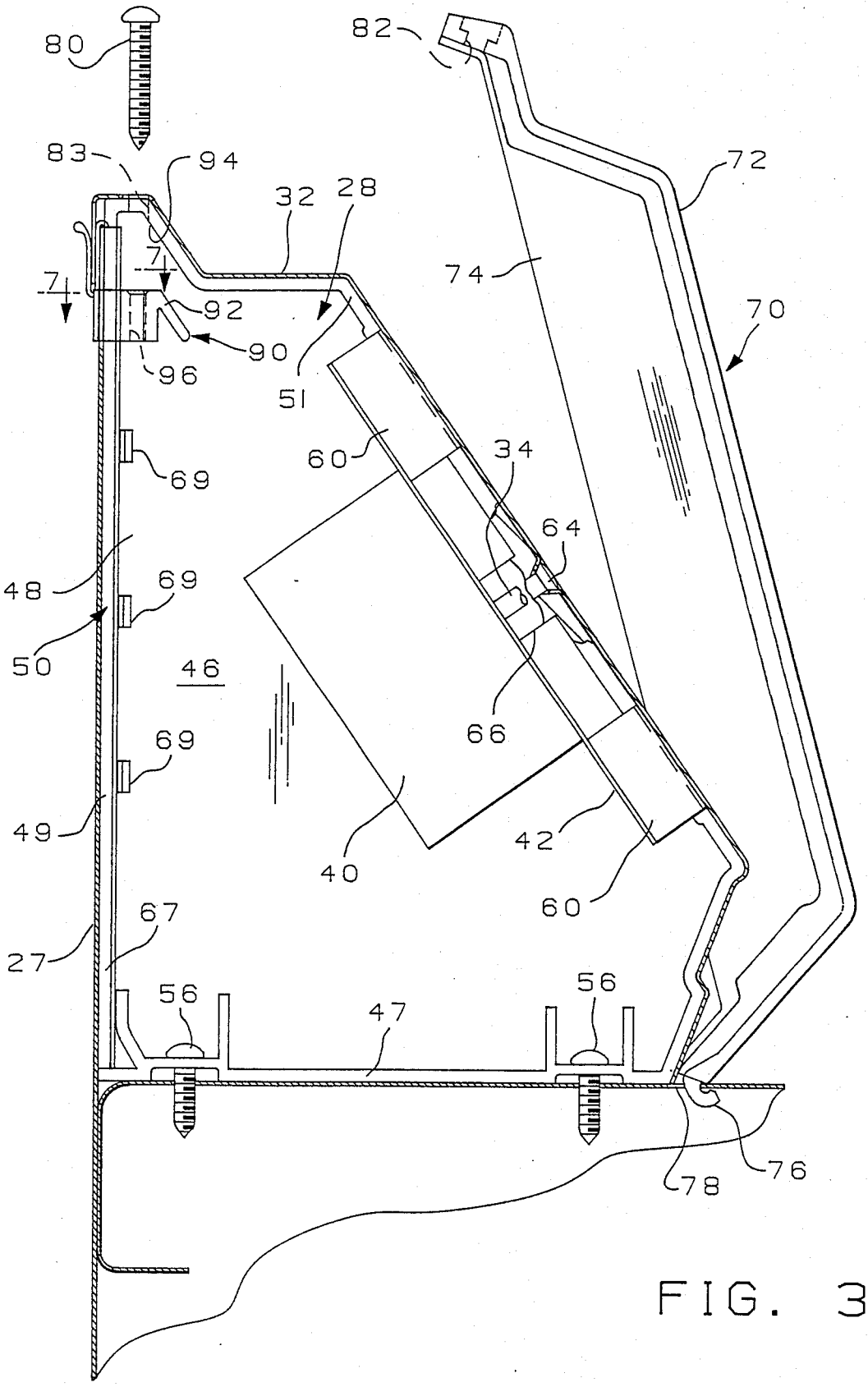
FIG. 3 is a vertical sectional view taken along line 3—3 of FIG. 1 showing some parts positioned prior to final assembly.

Referring now to FIG. 3, the electrical controls generally designated 40 may be mounted within the console to extend downwardly and rearwardly from a mounting plate 42, which is disposed inwardly of the cover member 32. The upper end or portion 27 of panel 26 provides a rear closure panel for rearwardly closing the inner space 46 within the console. Each end wall is generally a right-triangular-shaped member including an outer or vertical side wall portion 48. Extending inwardly relative to the console 12 and substantially perpendicular to side wall 48 is a peripheral wall 50. The peripheral wall 50 as best seen in FIGS. 2 and 3 includes a generally horizontal bottom wall portion 47 adapted to engage portion 22 of wall 16, a rear wall portion 49 extending upwardly at substantially a right-angle from portion 47 and adapted to engage portion 27 of wall 26 and an inclined front wall portion 51 interconnecting walls 47 and 49 forming the diagonal hypotenuse of the right-triangular shaped end walls 28.

As shown in FIGS. 2 and 3 the end walls 28 may be secured to the appliance top wall portion 22 by suitable screws 56 which as shown in FIG. 3 extend through the bottom wall portion 47 for threaded engagement with suitable openings 58 (FIG. 2) in the cabinet wall portion 22. The electrical control mounting plate 42 is provided at each end as shown in FIGS. 2 and 3, with ears or tab portions 60 which are dimensioned to be received in recesses 62 formed in the wall portion 51 to thereby support the tabs 60 so as to be flush with the surface of wall portion 51 of the end walls 28. The cover 32 as shown in FIGS. 2–5 is shaped to follow the contour of front wall portion 51 and overlie ears 60 of plate 42. Cover 32 may be secured at each end to end walls 28 by suitable screws 64 which extend into threaded engagement with a boss 66 in wall portion 51 of each end wall 28. The upper end 27 of rear panel 26 is captured by the wall portions 49 of the end walls 28 so as to prevent pivoting of panel 26 away from the cabinet 14. To this end, each side edge of portion 27 of panel 26 includes a forwardly projecting flange 67. Prior to securing the end walls 28 to the portion 22 as described above, the flanges 67 as shown in FIG. 7 are positioned so as to extend parallel to the inner face of wall portion 49. The side distal ends of the flanges 67 are located between tabs 69 and the inner face of the corresponding wall portion 49. This arrangement as mentioned above prevents pivoting of panel 26 away from the cabinet during final assembly of the cabinet and console as will be fully explained hereinafter.

The outer face of wall portion 51 of end walls 28 and accordingly the longitudinal end portions of cover 32 are covered by a locking cap members 70. The caps 70 include a front face portion 72 which generally follows the contour of wall portion 51 and an outer or side wall 74 which overlaps and covers a portion of side wall 48. One end of the cap 70 includes a pair of hook tabs 76 which are inserted in cooperating openings 78 in mounting portion 22 of top 16. In installing the cap 70 as shown in FIG. 3 the tabs 76 are placed in openings 78 and the cap 70 rotated to its assembled position wherein it rests on wall portion 51 as seen in FIGS. 1 and 4. In this position a screw 80 passes through opening 82 in cap 70 and opening 83 in wall portion 51 to engage a member 84 mounted in rear panel 26 to thereby hold cap 70 in place in a manner to be explained hereinafter.

In accordance with the present invention the cabinet 14 is arranged on the base 24 as mentioned above and then in the final assembly is secured relative to the base 24 and rear panel 26 of the support structure through the interaction of member 84 and the end walls 28 of console 12. To this end the upper edge of portion 27 of rear panel 26 is formed to include a pair of vertical notches 86 located inwardly of the flanges 67. Arranged for vertical movement in the notches 86 are the locking members 84. The members 84 includes a central body portion 85, a rearwardly projecting portion 87 and a forwardly projecting wedged shaped portion 89. The portions 87 of locking members 84 include a pair of vertical grooves 88 which are dimensioned to be slidably received in the notches 86 in the rear panel 26. The end of the forwardly projecting portion 89 of member 84 is wedge shaped so as to mate with the acute angle formed adjacent the intersection of the vertical wall portion 49 and inclined wall portion 51. Forming the front portion of the wedge is a yieldable portion 90 which is provided with a cam surface or incline 92 which is dimensioned to engage the cooperating surface 94 formed by the inner surface of inclined wall portion 51 adjacent the upper end of wall portion 49. With reference to FIGS. 4–6 it will be seen that as the screw 80 is threaded into opening 96 of locking member 84 the surfaces 92 and 94 are forced in engagement so as to securely pull the rear panel 26 into locking engagement with the rear wall portion 49 of the side walls 28.

It should be apparent to those skilled in the art that the embodiment described heretofore is considered to be the presently preferred form of this invention. In accordance with the Patent Statues, changes may be made in the disclosed apparatus and the manner in which it is used without actually departing from the true spirit and scope of this invention.

What is claimed is:

1. An appliance comprising:

an appliance cabinet having a mounting portion;

means supporting said cabinet, including a base member and a rear wall, said rear wall including a closure portion positioned adjacent to and extending above said mounting portion;

a control console structure for housing appliance control means; said console structure including a pair of spaced apart end walls, each of said end walls having a base flange, a rear flange and a face flange; said console structure also including a cover member for enclosing the appliance control means, said cover member having opposite ends mounted to respective ones of said end walls;

means for securing each of said base flanges to said cabinet mounting portion; and means for securing said console structure to said closure portion of said rear wall including, locking members mounted on said closure portion adjacent each of said end walls, said locking members including locking surfaces arranged to engage said face flanges on said end walls for drawing said closure portion of said rear wall into intimate relationship with said rear flanges, and fastening means for moving said locking members into engagement with said rear flanges of said end walls to thereby secure said closure portion to said rear flanges.

2. The appliance recited in claim 1 wherein said rear flange and said face flange of each of said end walls meet to form an acute angle junction; said means for securing said console structure to said closure portion of said rear wall includes channels in the upper end of said closure portion of said rear wall receiving slots in an end of said locking members; the other end of said locking members being formed to engage said acute angle junctions when said locking members are secured to said end walls.

3. The appliance recited in claim 2 wherein each face flange extends between the corresponding base flange and and rear flange and said cover member extends substantially the full length of each of said face flanges.

4. The appliance recited in claim 3 wherein one end of each of said cap members includes holding means engaging openings in said mounting portion of said cabinet, and a second opening in the other end of each of said cap members accommodates the corresponding fastening means for securing said cap members relative to said end walls.

5. The appliance recited in claim 2 further including a cap member arranged on said face flange of each of said end walls so as to cover said opposite ends of said cover member and the upper portion of said end walls.

6. The appliance recited in claim 1 further including an appliance control mounting plate having opposite ends arranged on said end walls beneath said cover member.

7. A clothes washer having:

a support structure including a base member and a rear panel;

a cabinet including a top having a mounting portion positioned adjacent said rear panel and a wrapper joined to said top and having side panels and a front panel;

a control console structure for housing washer control means and for maintaining said cabinet in assembled relationship to said support structure; said console structure including a pair of end walls and means securing said end walls to said top mounting portion in spaced relationship to each other;

each of said end walls including a base flange, a rear flange and a face flange extending between the corresponding base and rear flanges;

said console structure further including a cover portion having opposite ends mounted on and extending substantially the full length of the face flanges; and means for securing said end walls to said rear panel of said support structure, including locking members mounted on the portion of said rear panel adjacent each of said end walls; each of said locking members including a locking surface arranged to engage the face flange on the corresponding one of said end walls for drawing the corresponding rear flange into intimate relationship with said rear panels; and fastening means for moving said locking means into engagement with said end walls to thereby secure said control console structure and cabinet in relation to said support structure.

8. The washer recited in claim 7 wherein said rear panel includes an upper end extending above said mounting portion and said rear flanges engage said upper end of said panel.

9. The washer recited in claim 7 further including a mounting plate for supporting the washer control means, said mounting plate having opposite ends arranged on said end walls beneath said cover portion.

10. The washer recited in claim 7 further including a cap member arranged on said face flange of each of said end walls so as to cover said opposite ends of said cover portion and the upper portion of each of said end walls.

11. The washer recited in claim 10 wherein one end of each of said cap members includes holding means engaging openings in said mounting portion, and a second opening in the other end of each of said cap members accommodates said fastening means for securing said cap members relative to said end walls.

* * * * *